United States Patent [19]

Keleske

[11] 3,982,369

[45] Sept. 28, 1976

[54] INSULATED BUILDING BLOCK

[76] Inventor: Henry P. Keleske, 5515 N. Danbury Road, Milwaukee, Wis. 53217

[22] Filed: Apr. 18, 1975

[21] Appl. No.: 569,254

[52] U.S. Cl. ..... 52/407; 52/604; 52/612

[51] Int. Cl.[2] ..... E04B 2/00

[58] Field of Search ..... 52/404, 405, 406, 407, 52/309, 596, 603, 604, 612

[56] References Cited

UNITED STATES PATENTS

| | | | |
|---|---|---|---|
| 1,171,913 | 2/1916 | Wilson | 52/405 |
| 1,815,921 | 7/1931 | Lapof | 52/405 |
| 3,204,381 | 9/1965 | Perreton | 52/309 |
| 3,318,062 | 5/1967 | Grants | 52/407 |
| 3,546,833 | 12/1970 | Perreton | 52/405 |
| 3,704,562 | 12/1972 | Grants | 52/405 |

FOREIGN PATENTS OR APPLICATIONS

| | | | |
|---|---|---|---|
| 141,677 | 8/1953 | Sweden | 52/405 |

*Primary Examiner*—Price C. Faw, Jr.
*Assistant Examiner*—William Randolph
*Attorney, Agent, or Firm*—Wheeler, Morsell, House & Fuller

[57] ABSTRACT

An insulation strip made of closed cell plastic foam is formed in the center of a building block transverse to the webs thereof and parallel to the side walls. The insulation strip extends beyond the edge of the sidewalls by ¼ inch on all four side edges of the block so as to provide a ½ inch space for mortar joints between blocks when the blocks are stacked to form a wall. In one embodiment, the edges of the insulation strip are grooved in a cross-hatched pattern which tends to make the edges compressible, thereby permitting minor dimensional changes in the size of the mortar joint to keep the blocks aligned.

3 Claims, 5 Drawing Figures

INSULATED BUILDING BLOCK

BACKGROUND OF THE INVENTION

Insulating strips have been utilized in building blocks in the past as disclosed in U.S. Pat. No. 3,204,381 to Perreton and in U.S. Pat. No. 3,546,833 to Perreton. However, these prior art insulating strips were formed separately from the blocks and had to be manually inserted in the blocks prior to using the blocks to build a wall. Also, the dimensions and shape of the blocks were altered to adapt the blocks to receive the insulating strip.

SUMMARY OF THE INVENTION

In accordance with this invention, plastic insulating strips are cast in the center of standard building blocks and extend transversely to the block's webs and parallel to the sidewalls. The insulating strips extend beyond all four edges of the block by a predetermined amount to accomodate a mortar joint of predetermined width when the blocks are stacked to form a wall.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the invention, which is defined by the claims.

Figure 1:
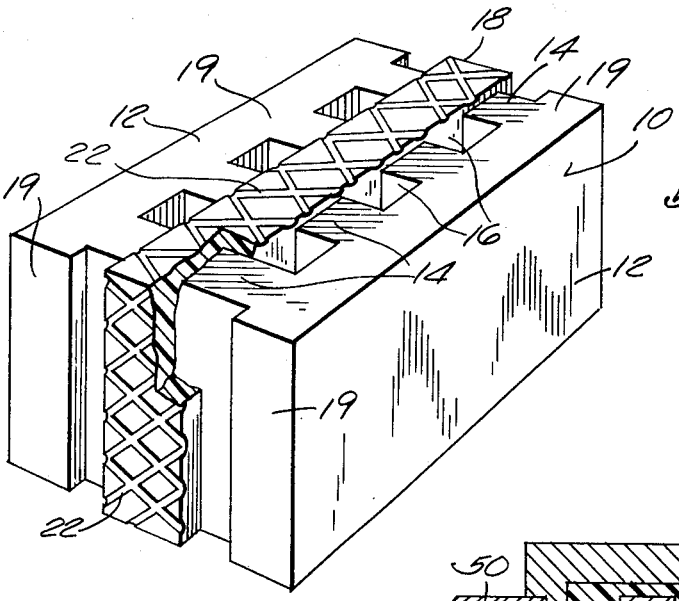
FIG. 1 is a perspective view of one embodiment of the invention with a portion of the insulating strip cut away to reveal the underlying web.
Figure 5:
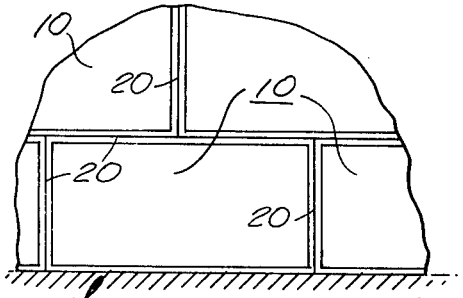
FIG. 5 is a fragmentary side elevation view of a plurality of the blocks of FIG. 1 stacked to form a wall.

FIG. 1 shows one embodiment of the invention which is formed on a standard building block 10 made of concrete or other suitable building block material and including spaced parallel sidewalls 12, and webs 14 which extend transversely of sidewalls 12 and are spaced apart to form voids 16 therebetween. This embodiment of the invention comprises an insulating strip 18 which is preferably made of a suitable closed cell plastic foam which is molded to the center of block 10 transverse to webs 14 and parallel to side walls 12. Insulating strip 18 extends ¼ inch beyond all four edges 19 of sidewalls 12 to provide a ½ inch space for mortar joints between blocks 10, as indicated at 20 in FIG. 5, when blocks 10 are stacked to form a wall. In this particular embodiment, grooves 22 which are arranged in a cross-hatched pattern are formed in all four edges of insulating strip 18 to make the edges compressible, thereby permitting minor dimensional changes in the size of the mortar joints to keep blocks 10 correctly aligned in the wall formed therewith. Grooves 22 are formed by cross-hatched ribs in the mold (not shown) in which insulating strip 18 is molded onto block 10.

Figure 2:
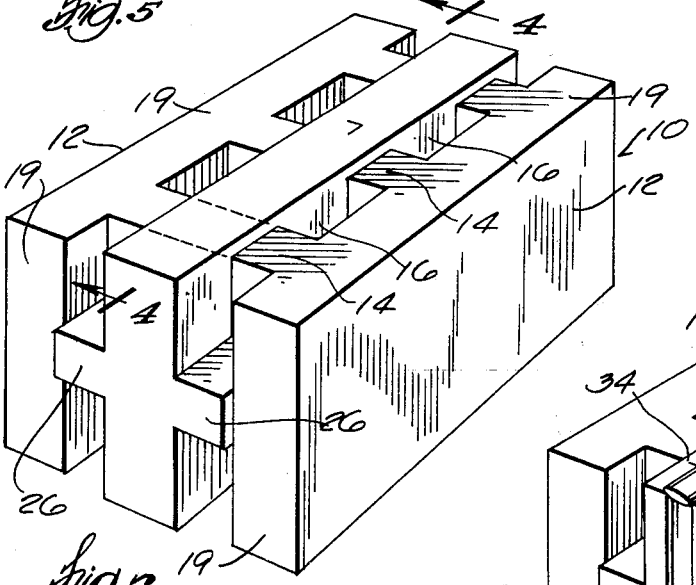
FIG. 2 is a perspective view of a second embodiment of the invention.

FIG. 2 shows a second embodiment of the invention in which a plastic insulating strip has central flanges 26 that extend transversely to the inside surface of sidewalls 12 to obstruct the passage of air through the open portions of voids 16. This enhances the insulating effect of insulating strip 24.

Figure 3:
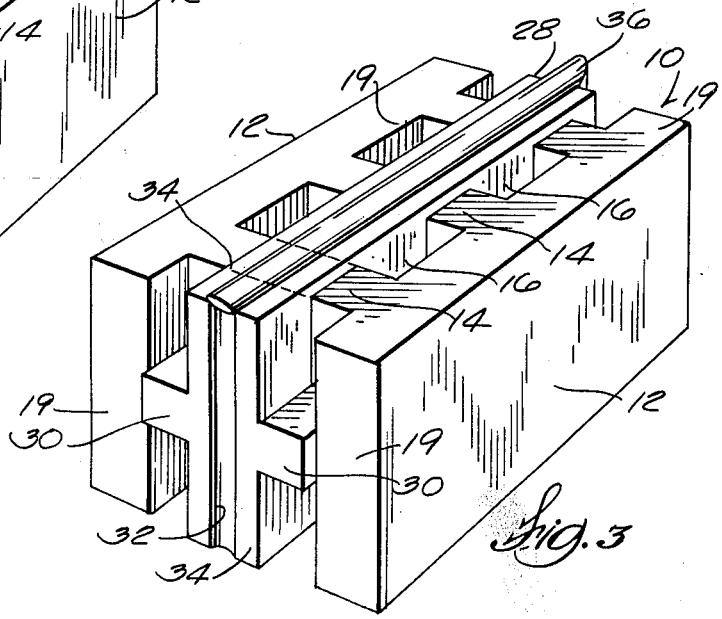
FIG. 3 is a perspective view of a third embodiment of the invention.

FIG. 3 shows another embodiment in which a plastic insulating strip 28 with central flanges 30 has central grooves 32 formed in all four edges 34 of strip 28 with plastic tongues 36 fastened to two adjacent grooves 32 to interact with grooves 32 on adjacent blocks 10 when they are stacked together to form a wall. Tongues 36 and grooves 32 automatically align blocks 10 as they are stacked.

Figure 4:
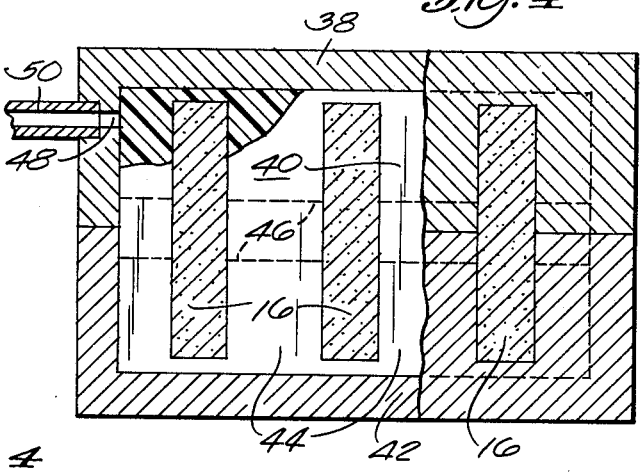
FIG. 4 is a longitudinal sectional view of a mold for casting the embodiment of FIG. 2.

FIG. 4 is a longitudinal sectional view of a suitable mold for forming the embodiment of FIG. 2 taken along the line 4—4 of FIG. 2. The mold includes an upper member 38 having downwardly depending cores 40 which fit within the open portions of voids 16 in FIG. 2. Upper mold member 38 fits on top of a lower mold member 42 having upwardly extending cores 44 which are symmetrical with cores 40. Cores 40 and 44 terminate at spaced apart edges 46 which define the upper and lower edges of flanges 26 in FIG. 2. Plastic foam is injected into the cavity in the mold members 38 and 42 through a suitable orifice 48 and conduit 50. Air is vented from the cavity as the plastic foam is injected by suitable air vents (not shown).

I claim:

1. In a rectangular building block having spaced parallel rectangular sidewalls with spaced webs extending transversely therebetween and voids between adjacent webs, the improvement comprising a thermal and moisture insulation strip attached to said webs and extending therebetween parallel to said sidewalls, said insulation strip extending beyond the edge of said sidewalls in the plane of the strip on all four edges of the block by a predetermined amount and having edges at right angles to said plane positioned to butt against the corresponding edge of an adjacent block in any direction to accomodate a mortar joint of predetermined width when the blocks are stacked to form a wall, and further comprising laterally extending flanges in the center of said insulating strip, said flanges contacting the inner surfaces of said sidewalls and acting to obstruct air flow through the open portion of said voids.

2. The building block of claim 1 in which said insulating strip is made of a closed cell plastic foam.

3. In a rectangular building block having spaced parallel rectangular sidewalls with spaced webs extending transversely therebetween and voids between adjacent webs, the improvement comprising a thermal and moisture insulation strip attached to said webs and extending therebetween parallel to said sidewalls, said insulation strip extending beyond the edge of said sidewalls in the plane of the strip on all four edges of the block by a predetermined amount and having edges at right angles to said plane positioned to butt against the corresponding edge of an adjacent block in any direction to accomodate a mortar joint of predetermined width when the blocks are stacked to form a wall, said insulating strip being composed of a substantially rigid closed cell plastic foam, and further comprising weakening grooves in the outer edges of said insulating strip arranged in a pattern to make said outer edges compressible, thereby permitting minor dimensional changes in stacked blocks to correctly align the same.

* * * * *